US006575459B1

(12) United States Patent
Kakiwaki et al.

(10) Patent No.: US 6,575,459 B1
(45) Date of Patent: Jun. 10, 2003

(54) RECORDING-MEDIUM TRANSPORT DEVICE

(75) Inventors: Shigeaki Kakiwaki, Nara (JP); Kaoru Higuchi, Tenri (JP); Len Ishikawa, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/590,971

(22) Filed: Jun. 9, 2000

(30) Foreign Application Priority Data

Jun. 11, 1999 (JP) ..... 11-165476

(51) Int. Cl.[7] ..... B65H 5/02

(52) U.S. Cl. ..... 271/242; 271/272; 271/276; 271/197

(58) Field of Search ..... 271/242, 272, 271/275, 276, 197, 198; 347/104, 264; 399/388, 395

(56) References Cited

U.S. PATENT DOCUMENTS 5,197,812 A 3/1993 Worley et al. ..... 400/635
5,740,728 A * 4/1998 DeBarber et al. ..... 271/198 X
5,851,008 A * 12/1998 Dilanchian et al. ..... 271/242 X

FOREIGN PATENT DOCUMENTS

JP 6-135613 5/1994

OTHER PUBLICATIONS

"Intelligent Active Friction Retard Paper Feeder with Wide Latitude Critical Parameter Control"; Rebres, Robert P.; Xerox Disclosure Journal; vol. 19, No. 2, Mar./Apr. 1994, pps. 151–152.

EPO Form 1507.0 (Search Report Communication dated Jan. 22, 2002).

* cited by examiner

*Primary Examiner*—David H. Bollinger
(74) *Attorney, Agent, or Firm*—Dike, Bronstein, Roberts & Cushman Intellectual Property Practice Group Edwards & Angell, LLP; David G. Conlin; George W. Hartnell, III

(57) ABSTRACT

A recording-medium transport device includes a pair of pinch rollers arranged closer to a printing head than to a subordinate roller and pinching and transporting a belt and a sheet of paper toward the printing head. The pair of pinch rollers can pinch the sheet of paper together with the belt, while maintaining the belt flat. As such, an image of high quality can be formed, e.g., printed on the recording medium. Furthermore, the recording medium does not divert from a transporting path. Thus reliable image formation can be achieved.

20 Claims, 4 Drawing Sheets

RECORDING-MEDIUM TRANSPORT DEVICE

BACKGROUND OF THE INVENTION

1. Field of the Invention

The present invention relates generally to devices incorporated into an image recording apparatus or the like used to form, e.g., print an image on a sheet of paper or other types of recording media, for transporting a recording medium, and in particular to improvements of such devices driving a belt to transport a recording medium.

2. Conventional Art

Printers and copiers are conventionally known apparatuses for forming, e.g., printing an image on a sheet of paper, film or other types of recording media, as disclosed for example in Japanese Patent Laying-Open No. 6-135613. Generally, such apparatuses employ electro-photography, ink-jetting and the like to form an image.

In electro-photography, a tonered image formed on a photoreceptor drum is transferred onto a recording medium to form an image on the recording medium. In ink-jetting, a printing head jets ink toward a recording medium to form an image on the recording medium.

The above two methods each employ a belt drive device as means for transporting a recording medium. Ink-jet printers using this belt drive device typically have a configuration, as described below:

As shown in FIG. 4, a belt drive device of this type includes a drive roller a, a subordinate roller b and a tension roller c, with an endless belt d engaged therearound. Drive roller a, connected to a drive shaft of a motor (not shown), receives the motor's driving force and thus rotates. As drive roller a rotates, belt d in the figure runs in a direction A. Opposite to subordinate roller b, on an upper side in the figure, a pinch roller e is arranged to cooperate with subordinate roller b to pinch belt d. In a vicinity of subordinate roller b, a sheet feed cassette f is arranged, from which a recording medium (a sheet of paper) g is drawn and transported in direction A, pinched together with belt d between subordinate roller b and pinch roller e, as belt d runs.

A printing head h is arranged above belt d between drive roller a and subordinate roller b. The portion of belt d between drive roller a and subordinate roller b will be referred to as a span s. Printing head h is a linear head or a serial head. The linear head has a multitude of jet nozzles depending on the resolution of interest that are arranged across a printing width as required in a direction perpendicular to the plane of FIG. 4, e.g., 200 mm for a sheet of the A4 size. The serial head has several tens to hundreds of jet nozzles in direction A as shown in FIG. 4 and prints an image on recording medium g as it moves in a direction perpendicular to the plane of FIG. 4.

In printing an image, as the belt drive device is driven recording medium g is drawn from sheet feed cassette f, pinched together with belt d between subordinate roller b and pinch roller e and thus transferred in direction A.

For printing head h in the form of the linear head, recording medium g is continuously transferred, while the printing head's nozzles jet ink appropriately to print an image on recording medium g.

For printing head h in the form of the serial head, recording medium g is initially transferred to the position at which printing head h is arranged.

When recording medium g has arrived there, belt d halts. Then printing head h jets ink through its nozzles as it moves in the direction perpendicular to the plane of FIG. 4, and it thus prints an image. When printing head h has arrived at one end of recording medium g, belt d again starts to run and then stops after recording medium g has been moved by a predetermined distance. Then printing head h then again moves in the direction perpendicular to the plane of FIG. 4 and thus prints an image. Thus, the print operation by printing head h and the recording-medium transport operation by the belt drive device are alternately provided to print an image on recording medium g.

One exemplary device of this type also includes a platen chamber i arranged on a back side of the belt's span s existing between drive roller a and subordinate roller b. Platen chamber i can aspirate recording medium g on belt d so that recording medium g does not displace and is thus transported satisfactorily. To do so, platen chamber i has an upper surface provided with multiple aspiration holes j. Similarly, belt d is also provided with multiple aspiration holes (not shown). When platen chamber i is driven or a negative pressure is produced, an aspiration force is produced at each aspiration holes of belt d. Thus, belt d aspirates recording medium g to prevent any positional displacement of recording medium g while transporting recording medium g.

The conventional belt drive device configured as above, however, tends to transport recording medium g by a distance larger than a predetermined distance. If such event occurs, a difference would be introduced between the driveability of belt d and the transportability of recording medium g. Thus, recording medium g would slide relative to belt d and thus be positionally displaced from a predetermined position. As a result, recording medium g would be transported with less precision or worse it would come off belt d and contact printing head h or divert from a transporting path and jam up the machine of interest, resulting in an unsatisfactory print operation. As such, recording-medium transport devices using such conventional belt drive device are still disadvantageous in transporting recording medium g.

The present inventors have studied what introduces a difference between the driveability of belt d and the transportability of recording medium g and have found that such difference is introduced by the following event:

More specifically, it has been found that, as shown in FIG. 5, when recording medium g is introduced between subordinate roller b and pinch roller e, in a vicinity of the portion pinched by rollers b and e, which will be referred to as a nip hereinafter, belt d has a front surface running at an temporarily increased rate, which introduces the difference between the driveability of belt d and the transportability of recording medium g. More specifically, belt d around subordinate roller b has an expanding front surface and a contracting back surface. Furthermore, as indicated in FIG. 5 by a broken line, belt d has a layer approximately intermediate as seen in a direction of the belt's thickness that neither expands nor contracts.

The front surface of belt d around subordinate roller b, expanding, runs at a local, higher rate than the belt's back surface and intermediate layer.

For example, if ω represents a rate at which subordinate roller b revolves, rn represents a distance from the center of subordinate roller b to the intermediate layer of belt d, and Δr represents a distance from the intermediate layer of belt d to the front surface of belt d, then belt d around subordinate roller b has a front surface running at a rate Vin:

$$Vin=(rn+\Delta r)\times\omega \quad (1).$$

Furthermore, the intermediate layer, neither expanding nor contracting, runs at a rate Vn:

$$Vn=rn\times\omega \quad (2).$$

As such, the belt's front surface runs faster than the belt's intermediate layer by the difference between the two rates, i.e., $\Delta r\times\omega$. While the front surface of belt d around subordinate roller b runs faster than the intermediate layer of belt d therearound, a front surface of belt d not around subordinate roller b, e.g., that of belt d opposite to printing head h, no longer expands and thus runs at a reduced rate and thus the same rate as the belt's intermediate layer.

Thus, belt d has a front surface running faster at subordinate roller b (at a rate V1 in FIG. 5) than at printing head h (at a rate V2 in FIG. 5). Because of such difference in rate, in FIG. 5 at the nip there would work a force which would transport recording medium g on a front surface of belt d at a rate greater than that of the intermediate layer of belt d. That is, recording medium g is transported farther at the nip than at printing head h. As such, recording medium g cannot contact the front surface of belt d, with a result that recording medium g and belt d slide relative to each other or recording medium g comes off the front surface of belt d. Consequently, recording medium g would be brought into contact with printing head h or divert from a transporting path and jam up the machine of interest.

SUMMARY OF THE INVENTION

One object of the present invention is to achieve an image formation, wherein a variation in driveability between a portion of a belt engaging and contacting a roller and a portion of the belt out of contact with the roller does not have any effect on a recording medium being transported, to reliably transport the recording medium to form on the recording medium an image of high quality as well as prevent the recording medium from diverting from a transporting path and thus achieve reliable image formation.

In order to achieve the above object, the present invention provides a recording-medium transport device configured to have a plurality of rollers with an endless transport belt engaged therearound and having a portion corresponding to a span for transporting a recording medium, having a transporting side for carrying a recording medium on which image formation means forms an image. The recording-medium transport device is characterized by a pair of pinch rollers contacting a transporting side of the recording-medium transporting span and a back side of the span, respectively, while maintaining the span flat, to pinch the recording medium together with the endless transport belt and thus transport the recording medium toward the image formation means.

As such, the endless transport belt has a transporting side bearing thereon and thus transporting a recording medium pinched together with the endless transport belt by the pair of pinch rollers. The pair of pinch rollers pinch a portion of the belt out of contact with the plurality of rollers. Thus the pair of pinch rollers pinch a portion of the endless transport belt which does not have a curve. As such, the belt does not have an expanding surface and in a vicinity of the pair of pinch rollers the belt has a surface running at a constant rate while transporting the recording medium, on which an image formation means forms an image. Thus, there would not be a difference introduced between the driveability of the belt and the transportability of the recording medium, nor would the recording medium slide relative to the belt or be positionally displaced from a predetermined position. Thus the recording medium can be transported satisfactorily, with high precision. As such, the recording medium does not come off the belt or contact a printing head or the like or divert from a transporting path or thus jam up the machine of interest.

In one embodiment of the present invention, the plurality of rollers with the endless transport belt therearound correspond to a drive roller and a subordinate roller and rotating and thus driving the drive roller allows the endless transport belt to run so that the endless transport belt has an upper surface transporting the recording medium, while the pair of pinch rollers includes an outer pinch roller in contact with the upper surface of the endless transport belt and an inner pinch roller in contact with a back surface of the endless transport belt, wherein the drive roller, the subordinate roller and the inner pinch roller are arranged to have their respective upper edges aligned in a single plane.

In another embodiment, as is similar to the above, the endless transport belt has an upper surface adapted to transport a recording medium, while on a back side of the recording-medium transporting span of the belt there is provided aspiration means producing a force to aspirate the recording medium on the endless transport belt, wherein the pair of pinch rollers includes an outer pinch roller in contact with the upper surface of the endless transport belt and an inner pinch roller in contact with an back surface of the endless transport belt and are arranged between a roller with the belt engaged therearound and the aspiration means and wherein the drive roller, the subordinate roller, the aspiration means and the inner pinch roller have their respective upper edges aligned in a single plane.

As such, there can be implemented a configuration for pinching the recording-medium transporting span of the endless transport belt between the pair of pinch rollers while maintaining the span flat. In particular, if the aspiration means is also provided, its aspiration allows the recording medium to be aspirated on the endless transport belt to reliably prevent the recording medium from sliding relative to the belt and having a positional displacement from a predetermined position, thus more reliably transporting the recording medium.

In the present invention, the recording-medium transport device preferably has the pair of pinch rollers generally equal in outer diameter to allow the endless transport belt to have a front surface and a back surface contacting the paired pinch rollers in the same condition. This ensures that the endless transport belt pinched by the pair of pinch rollers is flat.

In another embodiment the recording-medium transport device includes registration means starting to run the endless transport belt with a recording medium having its preceding edge abutting between the endless transport belt and an outer pinch roller of the pair of pinch rollers in contact with an upper surface of the endless transport belt, to register the recording medium so that a side of the recording medium that corresponds to the recording medium's preceding edge extends orthogonal to a direction in which the endless transport belt runs, for transporting the recording medium.

With the recording medium having its preceding edge abutting between the pair of pinch rollers and the endless transport belt, the pair of pinch rollers and the endless transport belt, in contact with each other, form therebetween a line (parallel to each pinch roller's rotation axis) parallel to the preceding edge of the recording medium. Thus the recording medium with its preceding edge satisfactorily registered in position passes through the pair of pinch rollers.

Running the endless transport belt with the recording medium thus registered allows the recording medium to be transferred, registered on the endless transport belt, with a longitudinal direction of the preceding edge of the recording medium orthogonal to a direction in which the endless transport belt runs.

In the present invention, preferably the recording-medium transport device is incorporated into a recording-medium transport system of an image recording apparatus to transport a recording medium on the recording-medium transporting span of the belt and pass the recording medium through the pair of pinch rollers before the image formation means form an image on the recording medium. As such, there can be obtained a specific application of the recording-medium transport device of the present invention, allowing the image recording apparatus to form an image of high quality.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will now be described with reference to the drawings. The present embodiment will be described in conjunction with an ink-jet printer with the present invention applied.

Configuration

Figure 1:
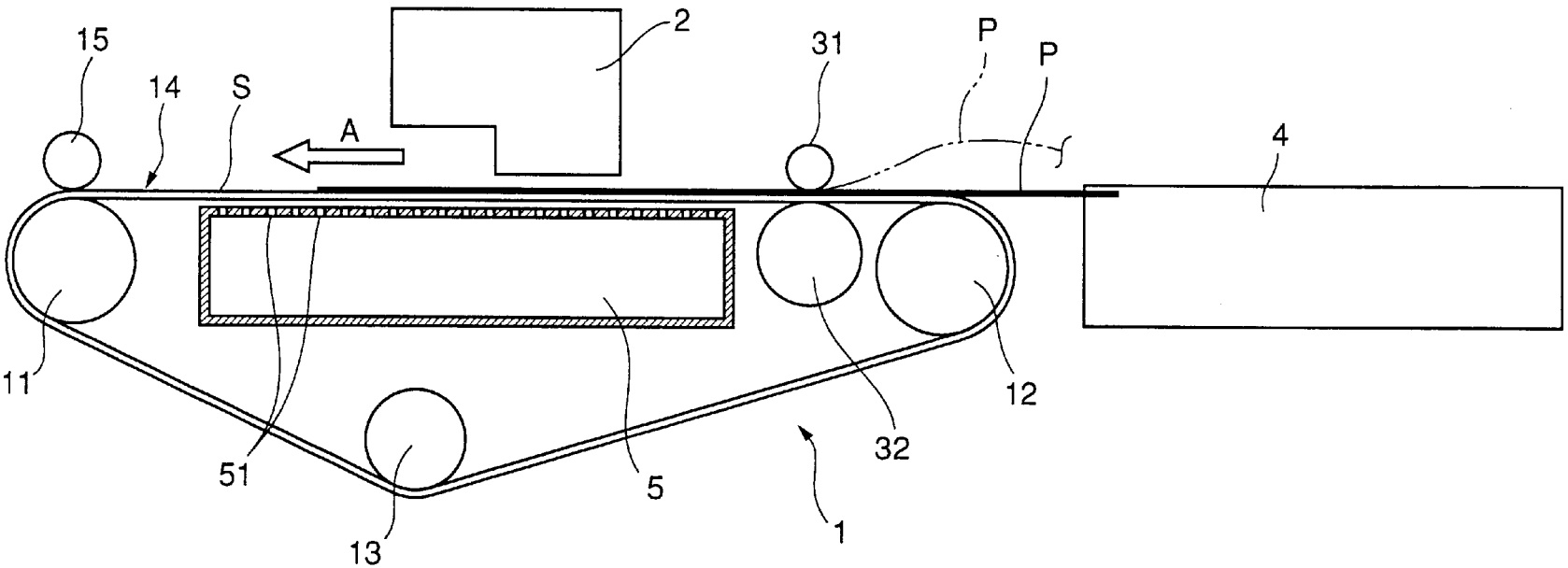
FIG. 1 schematically shows a structure of the transport and print systems of a printer of a first embodiment of the present invention.

FIG. 1 schematically shows a printer of the present embodiment, with a transport system transporting a sheet of paper P as a recording medium and a print system printing an image on the sheet of paper P transported. The sheet of paper P is transported by a transport device corresponding to a belt drive device 1 including a drive roller 11, a subordinate roller 12 and a tension roller 13 with an endless belt 14 engaged therearound. Drive roller 11, connected to a drive shaft of a motor (not shown), receives the motor's driving force and thus rotates. As drive roller 11 rotates, belt 14 in the figure runs in a direction A. The motor is for example a stepping motor driving the roller intermittently for each predetermined step angle. Linked to the motor's driving ability, belt 14 also runs intermittently. Above drive roller 11 is arranged a pinch roller 15 cooperating with drive roller 11 to pinch belt 14.

A printing head 2 as image formation means is arranged above a span S of belt 14 that exists between drive roller 11 and subordinate roller 12. Printing head 2 is a serial head having several tens to hundreds of jet nozzles in direction A as shown in FIG. 1 (a direction in which the sheet of paper P is transported). Printing head 2 also has means (not shown) for moving the head in a direction perpendicular to the plane of FIG. 1. Printing head 2 is provided with cartridges for yellow, magenta, cyan and black colors, allowing full-color printing.

Furthermore, as a characteristic of the present embodiment, a pair of pinch rollers 31 and 32 is provided at the belt's span S in a vicinity of subordinate roller 12 to pinch belt 14 at its front surface or transporting side and back surface. The pinch-roller pair is formed of an outer pinch roller 31 positioned on a front surface of belt 14 and an inner pinch roller 32 positioned on a back surface of belt 14. Inner pinch roller 32 is smaller in diameter than drive roller 11 and subordinate roller 12. Outer pinch roller 31 is smaller in diameter than inner pinch roller 32. More specifically, drive roller 11 and subordinate roller 12 has an outer diameter of 25 mm, inner pinch roller 32 has an outer diameter of 20 mm, and outer pinch roller 31 has an outer diameter of 10 mm. The pair of pinch rollers 31 and 32 is arranged to maintain the belt's span S flat. More specifically, inner pinch roller 32 has an upper edge positioned on a straight line linking an upper edge of drive roller 11 and that of subordinate roller 12, and outer pinch roller 31 has a lower edge spaced from the upper edge of inner pinch roller 32 by a distance corresponding approximately to the belt's thickness.

Upstream of subordinate roller 12 (in the figure, on the right hand) is provided a sheet feeding cassette 4 housing multiple sheets of paper P. As belt drive device 1 is driven, a sheet of paper P is drawn from sheet feeding cassette 4 and thus transported on belt 4.

Furthermore, a platen chamber 5 is arranged as aspiration means on a back side of the belt's span S. Platen chamber 5 is spaced from subordinate roller 12 for example by 40 mm. Platen chamber 5 corresponds to a container in the form of a generally rectangular parallelepiped having an upper surface positioned to generally match the straight line linking the upper edge of drive roller 11 and that of subordinate roller 12. Furthermore, platen chamber 5 has an upper surface provided with a plurality of aspiration holes 51 and also has a fan (not shown) driven to create a negative pressure inside the container to produce a force for aspirating the sheet of paper P on belt 14. Thus, the sheet of paper P can be free of displacement relative to belt 14 and thus transported satisfactorily.

Figure 2:
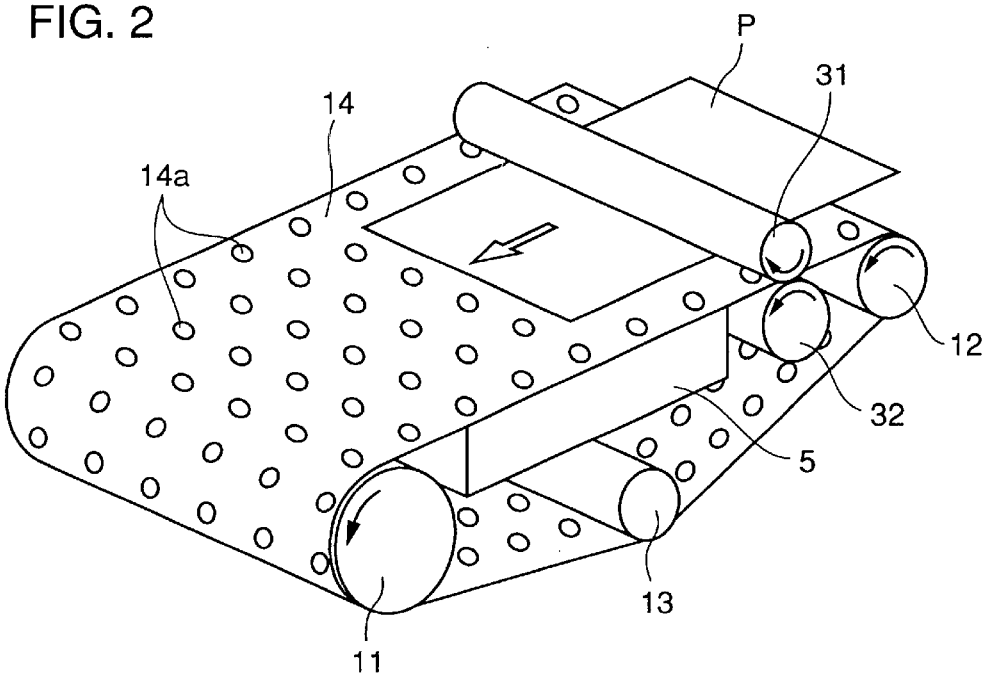
FIG. 2 is a perspective view of a structure of the transport system of the printer shown in FIG. 1.

As shown in FIG. 2, belt 14 also has a plurality of aspiration holes 14*a* to cause a force aspirating the sheet of paper P on a surface of belt 14 when platen chamber 5 is driven. Belt 14 is formed of rubber such as urethane rubber, providing a large friction between the belt's surface and the sheet of paper P. Furthermore, belt 14 is for example 0.5 mm thick, with aspiration holes 14*a* provided in the directions of the length and width of belt 14, spaced for example by an equidistance, or at a pitch, of 20 mm. It should be noted that aspiration holes 14*a* may have a size and pitch set as desired. Furthermore, aspiration holes 14*a* may have a pitch in the direction of the length of belt 14 and a different pitch in the direction of the width of belt 14, rather than the same pitch in the two directions of belt 14. Aspiration holes 14*a* may stagger in arrangement. Furthermore, the platen chamber's aspiration force, the sheet's size, thickness, mechanical property and its surface condition such as whether it is a normal paper, a coated paper or any other type of paper, the rate at which the sheet is transported, and the like may also be set as desired.

Operation

The printer configured as above operates as described below:

When the printer starts to operate, drive roller 11 rotates as the motor is driven. As drive roller 11 rotates, belt 14 runs in direction A, as shown in FIG. 1. As belt drive device 1 is driven, a sheet of paper P is drawn from sheet feeding cassette 4. The sheet of paper P passes on an upper side of subordinate roller 12 and then arrives at the pair of pinch rollers 31 and 32.

Figure 3:
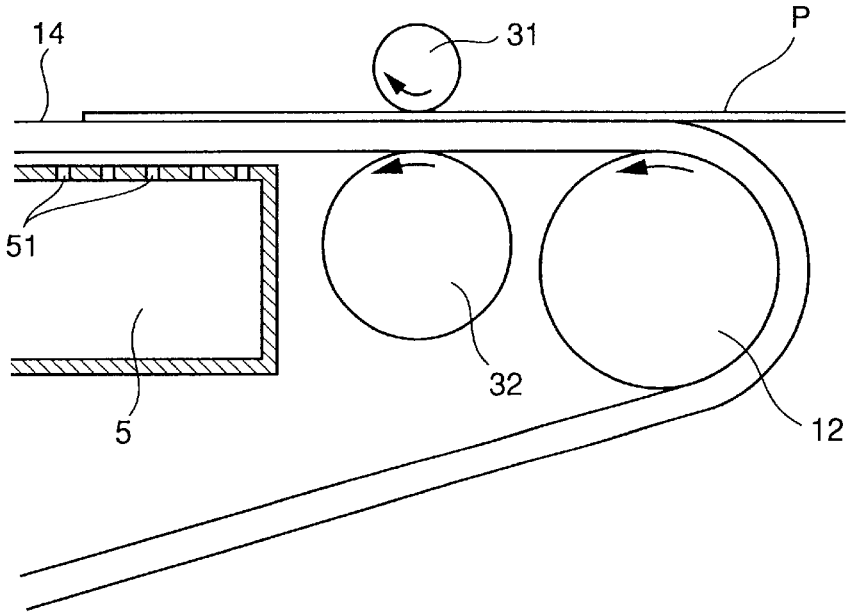
FIG. 3 shows a portion in a vicinity of a pair of pinch rollers of the FIG. 1 printer.
Figure 4:
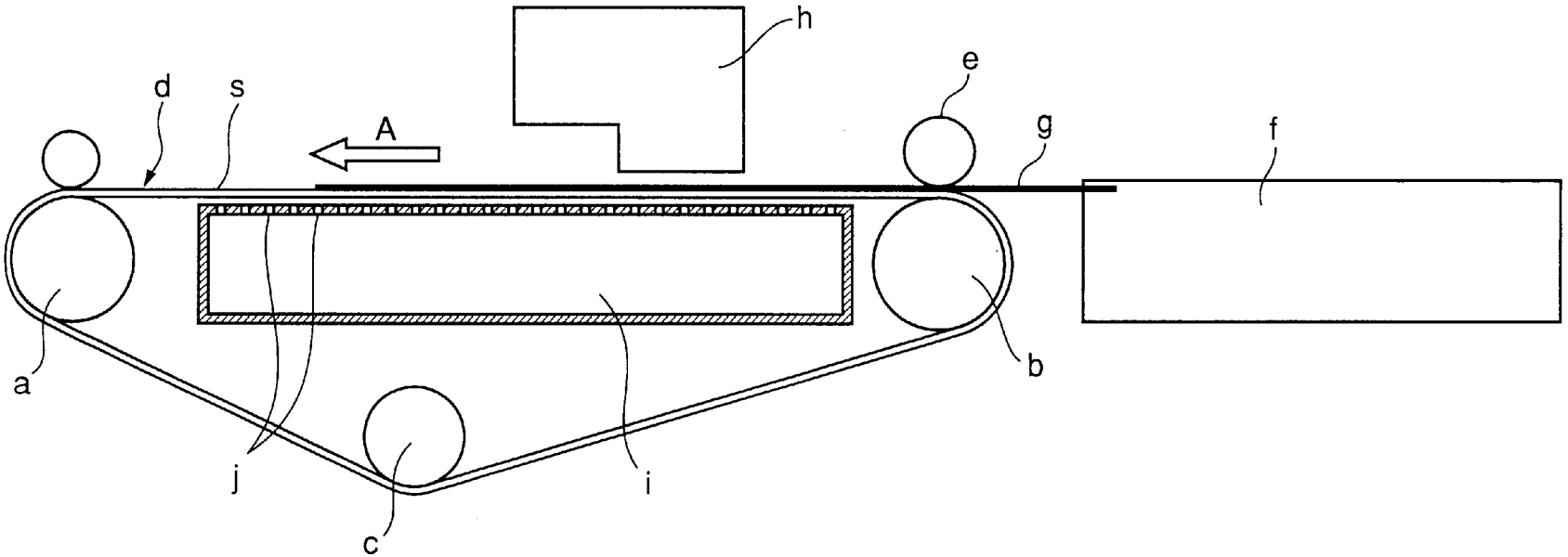
FIG. 4 PRIOR ART
FIG. 4 shows a conventional printer, as compared with FIG. 1.
Figure 5:
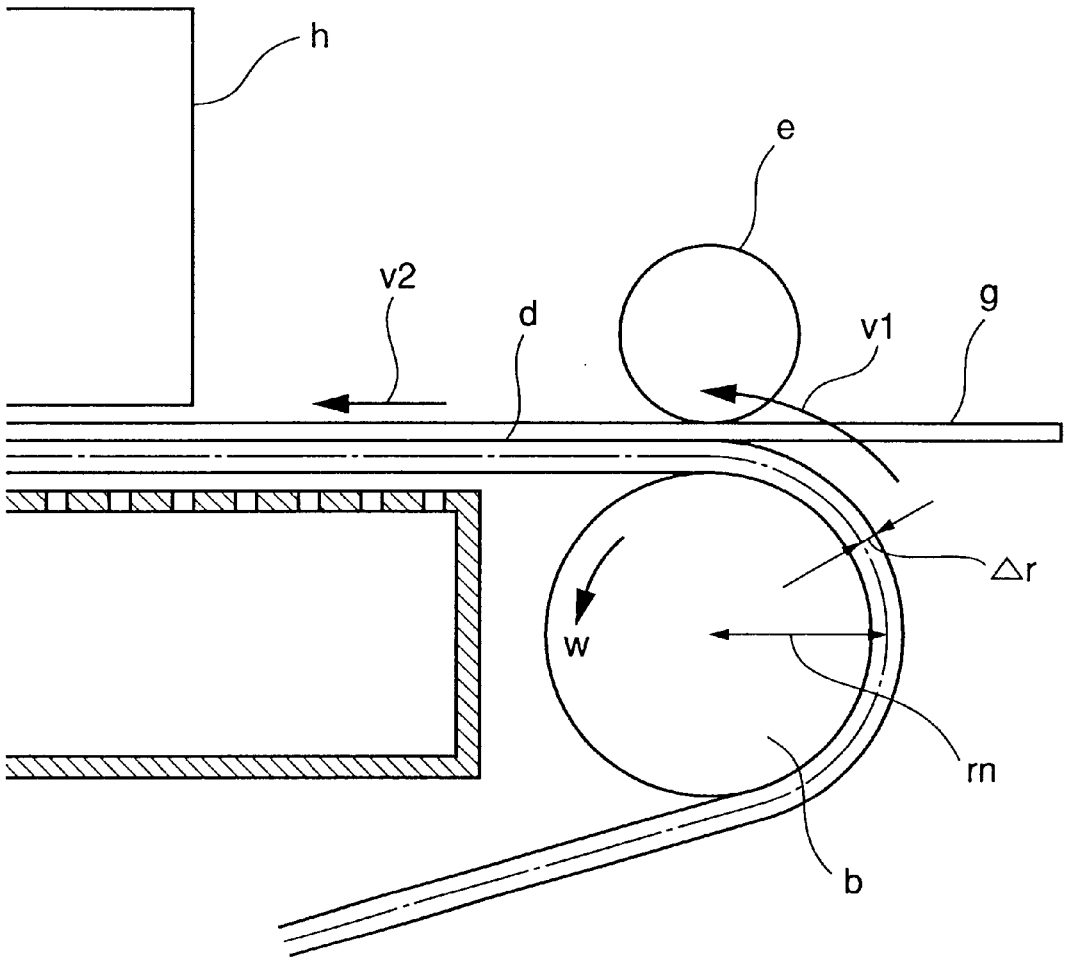
FIG. 5 PRIOR ART
FIG. 5 shows a portion in a vicinity of a subordinate roller in the conventional printer shown in FIG. 4.

Referring now to FIG. 3, as enlarged, the sheet of paper P, pinched together with belt 14 by the pair of pinch rollers 31 and 32, is transported toward the position at which printing head 2 is arranged, while belt 14 around subordinate roller 12 has a front surface expanding and thus running at a local, increased rate. In the present embodiment, however, the pair of pinch rollers 31 and 32 is provided at a position where the belt no longer has an expanding surface or the belt is not wound around subordinate roller 12, pinching the sheet of paper P together with belt 14. In other words, at a region where the belt has a front surface running at an unchanged rate the sheet of paper P is pinched and it is thus transported toward printing head 2. Thus the entirety of the sheet of paper P is transported in a stable manner.

When the sheet of paper P has arrived at the position where printing head 2 is arranged, the motor stops and belt 14 halts. Then printing head 2 jets ink through its nozzles as it moves in the direction perpendicular to the plane of FIG. 1, printing an image on the sheet of paper P. When printing head 2 has arrived at one end of the sheet of paper P, belt 14 again starts to run and then stops after the sheet of paper P has been moved by a predetermined distance. Then printing head 2 again moves in the direction perpendicular to the plane of FIG. 1 and thus prints an image. Thus, the image forming operation by printing head 2 and the sheet transporting operation by belt drive device 1 are alternately provided to print an image on the entirety of the sheet of paper P.

In this image forming operation, platen chamber 5 provides a force aspirating the sheet of paper P on belt 14. As such, the sheet of paper P can be free of displacement relative to belt 14 and thus transported satisfactorily.

Registration

In the present embodiment, the pair of pinch rollers 31 and 32 functions to register the sheet of paper P, maintaining it on belt 14 in a satisfactory registration. More specifically, the sheet of paper P on belt 14 is registered such that a longitudinal direction of its preceding edge (in FIG. 1, a direction perpendicular to the plane of the figure) is orthogonal to a direction in which belt 14 runs (direction A in the figure). The sheet of paper P can be registered, as described below:

The sheet of paper P can be registered by slightly curving the sheet of paper P drawn from sheet feeding cassette 4 and feeding the curved sheet of paper P to the pair of pinch rollers 31 and 32. More specifically, before drive roller 11 is driven or while the pair of pinch rollers 31 and 32 and belt 14 stop, a sheet feeding roller (not shown) is driven to draw the sheet of paper P from sheet feeding cassette 4. Then, with its preceding edge positioned between outer pinch roller 31 and belt 14, the sheet of paper P is curved slightly, as represented in FIG. 1 by a virtual line. In this condition, the sheet's recoverability pushes the sheet's preceding edge between outer pinch roller 31 and belt 14. Thus, outer pinch roller 31 has a line tangential to belt 14 (parallel to the revolution axis of outer pinch roller 31) that is parallel to the sheet's preceding edge. In other words, the sheet of paper P is transported to the pair of pinch rollers 31 and 32 with its preceding edge positioned, as corrected satisfactorily. With the sheet of paper P transported as above, driving drive roller 11 allows the sheet of paper P to be transported, registered on belt 14, with the longitudinal direction of the sheet's preceding edge orthogonal to the direction in which belt 14 runs. The present printer includes a controller (not shown) having registration means to register the sheet of paper P, as described above. In other words, the registration means controls the drawing of the sheet of paper P and the timing at which the motor is driven, to register the sheet of paper P, as described above.

Effect of the Embodiment

As has been described above, in the present embodiment, belt 14 has span S between drive roller 11 and subordinate roller 12 and the pair of pinch rollers 31 and 32 is provided at span S in a vicinity of subordinate roller 12 to maintain span S flat as it pinches and thus transports the sheet of paper P. Thus, in a vicinity of the pair of pinch rollers 31 and 32, i.e., a nip, and a portion opposite to printing head 2, belt 14 does not curve and thus transports the sheet of paper P as it is maintained flat. Thus the belt has a flat surface running at a constant rate from the nip to the portion opposite to printing head 2. As such, there would be no difference introduced between the driveability of belt 14 and the transportability of the sheet of paper P, nor would the sheet of paper P slide relative to belt 14 or have a positional displacement from a predetermined position. Thus, the sheet of paper P can be transported satisfactorily, with high precision. As such, images of high quality can be formed on the sheet of paper P. Furthermore, the sheet of paper P would not come off belt 14 nor would it contact printing head 2 or divert from a transporting path or jam up the machine of interest. Thus the sheet of paper p would not be smeared or damaged so that an image can be formed satisfactorily.

Other Embodiments

The above embodiment has been described in conjunction with an serial-head equipped inkjet printer with the present invention applied. However, the present invention is also applicable for example to linear-head equipped printers and electro-photography printers. The present invention is also applicable to image recording apparatus other than printers, such as copiers. Furthermore, the present invention may use recording media other than the sheet of paper P, such as various types of media including film.

While the present embodiment includes outer pinch roller 31 smaller in diameter than inner pinch roller 32, the present invention may alternatively have pinch rollers 31 and 32 equal in outer diameter. In such example, belt 14 can have a front surface and a back surface contacting pinch rollers 31 and 32 in the same condition. This ensures that belt 14 is flat at the nip. Thus there can be readily obtained a configuration allowing the above embodiment to operate effectively.

While the above embodiment includes subordinate roller 12, inner pinch roller 32 and platen chamber 5 having their respective upper edges aligned on a single straight line, inner pinch roller 32 slightly displaced vertically can also satisfactorily transport the sheet of paper P if such displacement is 1 mm or therearound.

Furthermore, there may be provided means for allowing pinch rollers 31 and 32 to be each precisely adjusted in level. Such means can precisely adjust pinch rollers 31 and 32 in level to allow belt 14 to have a front surface maintained flat if belt drive device 1 includes a component having a processing error or the like. Furthermore, if each pinch roller 31 and 32 can be precisely adjusted in level to allow belt 14 to voluntarily engage itself around pinch roller 31 and 32, the sheet of paper P would, for example, be introduced at any rate variable as desired. It should be noted however, that the rollers 31 and 32 be precisely adjusted so that the sheet of paper P does not slide on belt 14.

Furthermore, while the above embodiment has been described in conjunction with a printer equipped with platen chamber 5 for aspirating the sheet of paper P on belt 14, the present invention is also applicable to printers which do not include platen chamber 5.

Furthermore, belt 14 may have a surface formed of rubber such as urethane rubber and an internal portion reinforced with a core formed of a cloth woven with polyester fabric. In such example, belt 14 can transport a recording medium with high precision, with a high rigidity in a direction of tension.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A recording-medium transport device having a plurality of rollers with an endless transport belt engaged therearound for transporting a recording medium, said endless transport belt having a span disposed between a distal roller and a proximal roller, said span having a transporting side for bearing and transporting thereon a recording medium on which image formation means forms an image and a back side, said recording-medium transport device comprising:

a pair of pinch rollers separate from said plurality of rollers to pinch the recording medium together with said endless transport belt and thus transport the recording medium toward the image formation means, wherein said pair of pinch rollers includes an outer pinch roller and an inner pinch roller, wherein said outer pinch roller contacts the upper surface of the transporting side of the span of the endless transport belt and said inner pinch roller contacts the back side of the span of said endless transport belt.

2. The recording-medium transport device of claim 1 wherein said plurality of rollers comprises a drive roller and a subordinate roller, wherein said drive roller is rotated and thus driven to allow said endless transport belt to run and thus produce an upper surface on the transporting side of the span for transporting the recording medium.

3. The recording-medium transport device of claim 2, wherein the drive roller, the subordinate roller, and the inner pinch roller are configured and arranged so that their respective upper edges are aligned in a single plane.

4. The recording-medium transport device of claim 2, wherein the subordinate roller and the drive roller are greater than the outer pinch roller in outer diameter.

5. The recording-medium transport device of claim 2, the endless transport belt further having an aspiration means that is provided at the back side of the span of said endless transport belt to produce a force to aspirate the recording medium being transported on said endless transport belt.

6. The recording-medium transport device of claim 5, wherein said pair of pinch rollers includes an outer pinch roller and an inner pinch roller, wherein said outer pinch roller contacts the transporting side of the span of the endless transport belt and said inner pinch roller contacts the back side of the span of said endless transport belt, wherein said pair of pinch rollers is configured and arranged between said subordinate roller and said aspiration means.

7. The recording-medium transport device of claim 6, wherein the drive roller, the aspiration means, and the inner pinch roller are configured and arranged so that their respective upper edges are aligned in a single plane.

8. The recording-medium transport device of claim 2, wherein said pair of pinch rollers is disposed downstream of a portion of the endless transport belt contacting a circumferential surface of the subordinate roller.

9. The recording-medium transport device of claim 1, wherein the outer pinch roller is greater than the inner pinch roller in outer diameter.

10. The recording medium transport device of claim 1, wherein each pinch roller of said pair of pinch rollers substantially equal in outer diameter.

11. The recording-medium transport device of claim 1, wherein the device further comprises registration means to register the recording medium so that a side of the recording medium corresponding to a preceding edge of the recording medium extends orthogonal to a direction in which said endless transport belt runs.

12. The recording-medium transport device of claim 1, wherein the span remains substantially flat when the pair of pinch rollers pinches the recording medium together with said endless transport belt.

13. The recording-medium transport device of claim 1, wherein said pair of pinch rollers is disposed so that said span is maintained flat.

14. The recording-medium transport device of claim 1, the endless transport belt further having an aspiration means that is provided at the back side of the span of said endless transport belt to produce a force to aspirate the recording medium being transported on said endless transport belt.

15. The recording-medium transport device of claim 14, wherein said pair of pinch rollers includes an outer pinch roller and an inner pinch roller, wherein said outer pinch roller contacts the transporting side of the span of the endless transport belt and said inner pinch roller contacts the back side of the span of said endless transport belt, wherein said pair of pinch rollers is configured and arranged between said subordinate roller and said aspiration means.

16. An image recording system for recording an image on a recording medium, wherein the image recording system comprises:

a recording-medium transporting device; and an image formation means, wherein said recording-medium transport device, having a plurality of rollers with an endless transport belt engaged therearound for transporting a recording medium, said endless transport belt having a span disposed between a distal roller and a proximal roller, said span having a transporting side for bearing and transporting thereon a recording medium on which image formation means forms an image and a back side, comprises:

a pair of pinch rollers separate from said plurality of rollers to pinch the recording medium together with said endless transport belt and thus transport the recording medium toward the image formation means, wherein said pair of pinch rollers includes an outer pinch roller and an inner pinch roller, wherein said outer pinch roller contacts the upper surface of the transporting side of the span of the endless transport belt and said inner pinch roller contacts the back side of the span of said endless transport belt.

17. The image recording system of claim 16, said endless transport belt further having an aspiration means that is provided at the back side of the span of said endless transport belt to produces a force to aspirate the recording medium being transported on said endless transport belt.

18. The image recording system of claim 17, wherein said plurality of rollers comprises a drive roller and a subordinate roller, wherein said drive roller is rotated and thus driven to allow said endless transport belt to run and thus produce an upper surface on the transporting side of the span for transporting the recording medium.

19. The image recording system of claim 18, wherein said pair of pinch rollers includes an outer pinch roller and an inner pinch roller, wherein said outer pinch roller contacts the transporting side of the span of the endless transport belt and said inner pinch roller contacts the back side of the span of said endless transport belt, wherein said pair of pinch rollers is configured and arranged between said subordinate roller and said aspiration means.

20. The image recording system of claim 16, wherein each pinch roller of said pair of pinch rollers is substantially equal in outer diameter.

* * * * *